US008752804B2

(12) United States Patent
Taylor

(10) Patent No.: US 8,752,804 B2
(45) Date of Patent: Jun. 17, 2014

(54) WEDGE-ACTIVATED ROD CLAMP ASSEMBLY

(76) Inventor: Denzel K. Taylor, Crown Point, IN (US)

( * ) Notice: Subject to any disclaimer, the term of this patent is extended or adjusted under 35 U.S.C. 154(b) by 298 days.

(21) Appl. No.: 13/170,330

(22) Filed: Jun. 28, 2011

(65) Prior Publication Data

US 2012/0160990 A1 Jun. 28, 2012

Related U.S. Application Data

(60) Provisional application No. 61/359,868, filed on Jun. 30, 2010.

(51) Int. Cl.
*E04G 17/07* (2006.01)

(52) U.S. Cl.
CPC ..... *E04G 17/07* (2013.01)
USPC ..... 249/219.1; 249/46

(58) Field of Classification Search
USPC ..... 249/45, 46, 191, 213, 216, 219.1; 403/314, 324, 393, 396, 409.1
See application file for complete search history.

(56) References Cited

U.S. PATENT DOCUMENTS

| | | | | | |
|---|---|---|---|---|---|
| 302,519 | A | * | 7/1884 | Parsons | 278/65 |
| 526,123 | A | * | 9/1894 | Boots et al. | 403/396 |
| 748,056 | A | * | 12/1903 | Dulinsky | 403/314 |
| 1,251,256 | A | * | 12/1917 | Lynch et al. | 269/203 |
| 1,348,060 | A | * | 7/1920 | Sheppard | 249/7 |
| 1,379,457 | A | | 5/1921 | Loxterman | |
| 1,387,766 | A | * | 8/1921 | Colt | 249/190 |
| 1,438,250 | A | * | 12/1922 | Lyon | 269/309 |
| 1,513,199 | A | * | 10/1924 | Tompkins | 403/304 |
| 1,561,923 | A | * | 11/1925 | Heltzel | 249/6 |
| 1,634,422 | A | * | 7/1927 | Holmes | 411/511 |
| 1,651,787 | A | | 12/1927 | Venable | |
| 1,827,672 | A | | 10/1931 | Rogers | |
| 1,875,366 | A | * | 9/1932 | Beghetti | 249/216 |
| 1,936,740 | A | | 11/1933 | Wolf | |
| 2,162,349 | A | * | 6/1939 | Hillberg | 24/268 |
| 2,171,524 | A | * | 9/1939 | Gates | 24/28 |
| 2,338,025 | A | * | 12/1943 | Cooper | 254/104 |
| 2,395,204 | A | * | 2/1946 | Symons | 24/569 |
| 2,433,934 | A | * | 1/1948 | Symons | 249/190 |
| 2,661,516 | A | | 2/1950 | Yates | |
| 2,507,061 | A | * | 5/1950 | Symons | 24/1 |
| 2,663,925 | A | | 6/1950 | Yates | |
| 2,584,822 | A | * | 2/1952 | Symons | 249/190 |
| 2,640,249 | A | | 6/1953 | Symons | |
| 2,640,448 | A | * | 6/1953 | Roberts | 12/7.7 |
| 2,816,345 | A | * | 12/1957 | Symons | 249/191 |

(Continued)

*Primary Examiner* — Michael Safavi
(74) *Attorney, Agent, or Firm* — Hartman Global IP Law; Gary M. Hartman; Domenica N. S. Hartman

(57) ABSTRACT

A rod clamp assembly and method for securing a rod, for example, to secure and support concrete forms. The assembly includes a housing and a wedge member. The housing has pairs of oppositely-disposed sidewalls and oppositely-disposed endwalls. Each pair of sidewalls has a side passage that passes entirely through the housing, and the side passages of the pairs of sidewalls intersect each other to define an interior cavity within the housing. The pair of endwalls has an end passage that passes entirely through the housing and through the cavity within the housing to define an intersection with the cavity. The wedge member has a ramp feature at an end thereof, and a length that is sufficient so that the ramp feature enters the intersection between the side and end passages when the wedge member is inserted through the one of the side passages.

20 Claims, 4 Drawing Sheets

(56) References Cited

U.S. PATENT DOCUMENTS

| | | | | | |
|---|---|---|---|---|---|
| 3,103,730 | A | * | 9/1963 | Carlton | 249/45 |
| 3,648,962 | A | | 3/1972 | Farley | |
| 3,724,806 | A | | 4/1973 | Shoemaker | |
| 3,835,610 | A | * | 9/1974 | Harper et al. | 403/231 |
| 3,917,216 | A | | 11/1975 | Plough | |
| 4,208,030 | A | * | 6/1980 | Wilson | 249/217 |
| 4,221,357 | A | * | 9/1980 | Bowden et al. | 249/191 |
| 4,473,209 | A | * | 9/1984 | Gallis et al. | 249/191 |
| 4,579,312 | A | | 4/1986 | White | |
| 4,695,178 | A | * | 9/1987 | Era et al. | 403/14 |
| 4,712,764 | A | | 12/1987 | White | |
| 5,127,763 | A | * | 7/1992 | Kunoki | 403/314 |
| 5,251,868 | A | | 10/1993 | Trimmer et al. | |
| 5,261,635 | A | | 11/1993 | Flathau | |
| 5,265,836 | A | | 11/1993 | Dale | |
| 5,556,224 | A | * | 9/1996 | Niskanen | 403/379.2 |
| 5,888,015 | A | * | 3/1999 | Brown et al. | 403/379.1 |
| 6,234,465 | B1 | | 5/2001 | Sutton, Jr. | |
| 6,905,106 | B2 | | 6/2005 | Myers et al. | |

* cited by examiner

WEDGE-ACTIVATED ROD CLAMP ASSEMBLY

CROSS REFERENCE TO RELATED APPLICATIONS

This application claims the benefit of U.S. Provisional Application No. 61/359,868, filed Jun. 30, 2010, the contents of which are incorporated herein by reference.

BACKGROUND OF THE INVENTION

This invention relates to an apparatus for holding concrete forms together or in place, while concrete is being placed, or for any number or reasons a rod must be held.

Concrete forms are typically held together by standard form ties while placing concrete. Forms are manufactured to have a standard spacing for which the ties are made. If this spacing deviates from the standard spacing, then metal pencil rods and rod clamps are typically used to hold the non-standard forms together. The rod clamps that are used are conventional and have been in use for many years.

Conventional rod clamps are typically in the form of a metal casting having a hole through which a form tie or pencil rod (hereinafter referred to as rods) can be passed. A bolt is threaded into the casting in a direction perpendicular to the rod, so that the bold can be tightened to clamp against the rod and secure it in place within the casting. The casting has a flat side adapted to rest against a concrete form, and is sufficiently large to prevent the casting from slipping through the form when pressure is applied by the poured concrete. Rod clamps are normally placed on both sides of concrete forms, and must be held tight against the form while concurrently tightening the bolt to hold the rod in place. The bold must be sufficiently tightened to secure the rod, yet not so tight as to sever the rod.

Rod clamps of the type described above are widely used and work well if the bolts are not fouled, such as with concrete or corrosion. However, fouling is inevitable under the conditions in which the clamps are used. Furthermore, the bolt threads can eventually become stripped due to over-tightening or repetitive use. However, damage to the rod and stripping of the bolt threads are often not discovered until the concrete pressure is applied, at which point the clamp is no longer able to secure the forms and the forms give under the pressure from the concrete. If a clamp fails, the forms must be braced in some manner to keep the concrete from bulging the forms.

An alternative to the rod clamp described above comprises a metal piece through which a rod is passed. The metal piece does not use a bolt to secure the rod, but instead uses a notched hinged piece that is adapted to bias against the rod. This type of rod clamp has not been as widely adopted because the notch is prone to wear.

BRIEF DESCRIPTION OF THE INVENTION

The present invention provides a rod clamp assembly and method for securing a rod, for example, a form tie or pencil rod used to secure and support concrete forms.

According to a first aspect of the invention, the rod clamp assembly includes a housing and a wedge member. The housing has sidewalls and endwalls. The sidewalls are arranged to define at least first and second pairs of sidewalls, and the endwalls are arranged to define at least one pair of endwalls. The sidewalls of the first pair of sidewalls are oppositely-disposed from each other, the sidewalls of the second pair of sidewalls are oppositely-disposed from each other, and the endwalls of the pair of endwalls are oppositely-disposed from each other. Each of the first and second pairs of sidewalls has a side passage that passes entirely through the housing. The side passages have congruous cross-sectional shapes and are defined by side passage walls within the housing. The side passages of the first and second pairs of sidewalls intersect each other to define an interior cavity within the housing. The pair of endwalls has an end passage that passes entirely through the housing and through the cavity within the housing to define an intersection with the cavity. The end passage is defined by end passage walls within the housing. The wedge member has a first longitudinal end, an oppositely-disposed second longitudinal end, and at least a first ramp feature at the second longitudinal end that defines an edge that is not parallel to a longitudinal axis of the wedge member. The wedge member has a cross-sectional shape congruous to the cross-sectional shapes of the side passages of the housing, and a longitudinal length that is sufficient so that the first ramp feature enters the intersection between the end passage and one of the side passages when the wedge member is inserted through the one of the side passages of the housing.

Other aspects of the invention include methods of using the rod clamp assembly to secure and support concrete forms.

A technical effect of the invention is the versatility of rod clamp assembly and its ability to repetitively reused. Notably, the rod clamp assembly is more resistant to fouling than prior art rod clamps, since concrete, sand, dirt, rust and other potential foulants are able to flow completely through the rod clamp housing and are therefore less likely to be trapped within the housing. Foulants that become trapped within the housing are less likely to affect the operation of the assembly, and can be easily removed. In addition, the wedge member can be inserted through any one of four sides of the housing, allowing the wedge member to be installed from a more convenient location and orientation based on the placement of the housing. Installation of the wedge member does not require threads, notch, or any other special fastener, but instead can be installed by being forced into engagement with a rod passing through the housing, for example, by driving the wedge member with a hammer. As such, the rod clamp assembly does not comprise threads or other relatively delicate or precision features that are prone to damage from corrosion and fouling. The length of the wedge member can be sized so that full installation of the member involves completely driving the member into the housing until an abutment feature on the wedge member abuts the housing.

Other aspects and advantages of this invention will be better appreciated from the following detailed description.

DETAILED DESCRIPTION OF THE INVENTION

Figure 8:
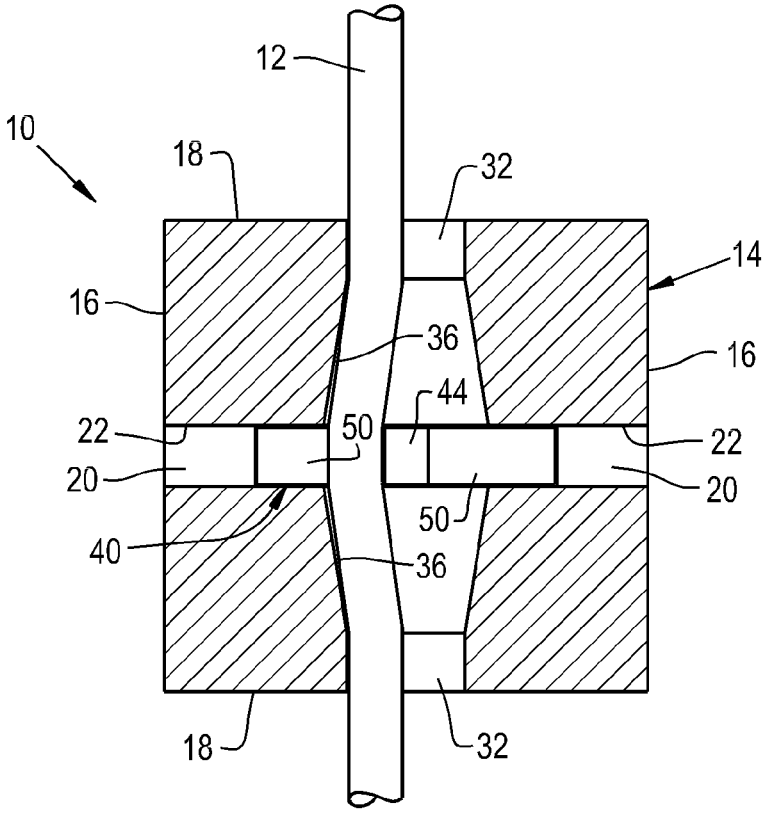
FIG. 8 is a cross-sectional view of the assembly of FIGS. 6 and 7 taken from the section line 8-8 of FIG. 6.

FIGS. 1 through 7 represent components of a rod clamp assembly 10 capable of being assembled with a rod 12, as represented in FIG. 8. The assembly 10 and rod 12 can be used for a variety of applications, a notable example of which is to secure and support a concrete form. Rods (form ties) of the type used with concrete forms typically have a circular cross-sectional shape and size to withstand the stresses associated with loads required to support concrete forms. A typical but nonlimiting example is a rod having a diameter of about one-quarter inch (about 6 mm).

As represented in FIGS. 1 through 4, the rod clamp assembly 10 includes a rod clamp housing 14 adapted to be assembled with a wedge member 40 (FIGS. 5 through 7) to secure the rod 12 within the housing 14 (FIG. 8). The housing 14 can be constructed of various materials using various fabricating processes, including the assembly of subcomponents to form the housing 14. The embodiment of the housing 14 shown in FIGS. 1 through 4 has a cubical exterior shape, and as such has four sidewalls 16 and two endwalls 18 that are disposed transverse to the sidewalls 16. Due to the cubical shape of the housing 14, the sidewalls 16 are arranged as pairs that are oppositely-disposed from each other, as are the end walls 18.

Figure 1:
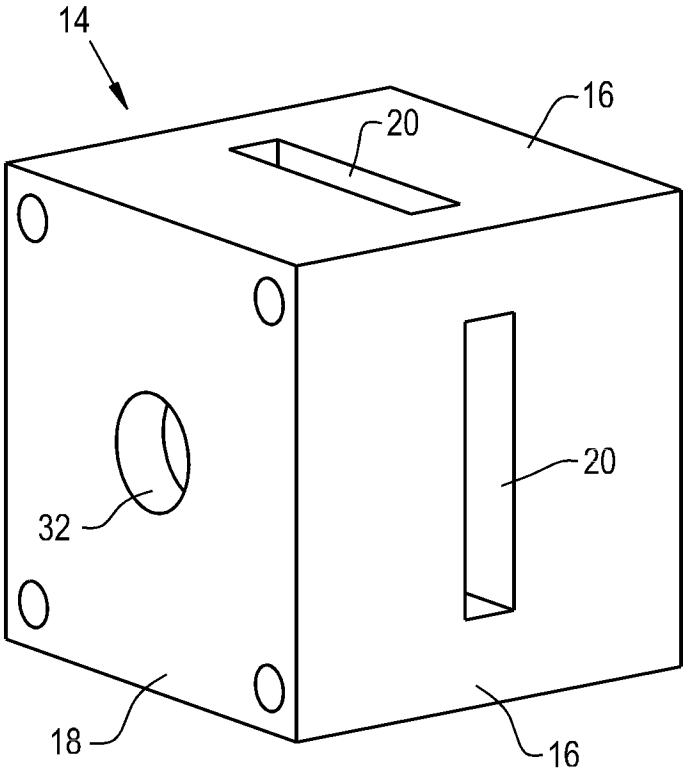
FIGS. 1 and 2 are perspective and top views, respectively, of a rod clamp housing in accordance with a preferred embodiment of this invention.
Figure 2:
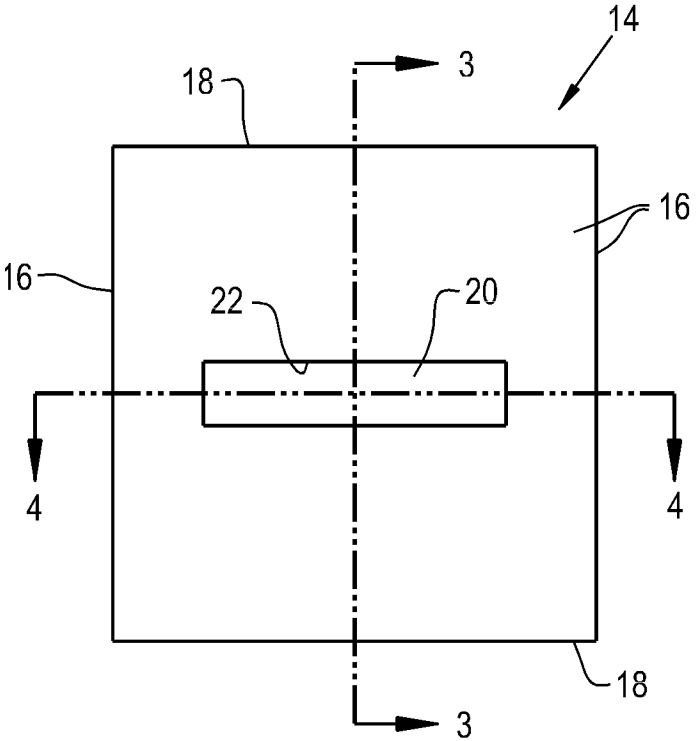
Figure 4:
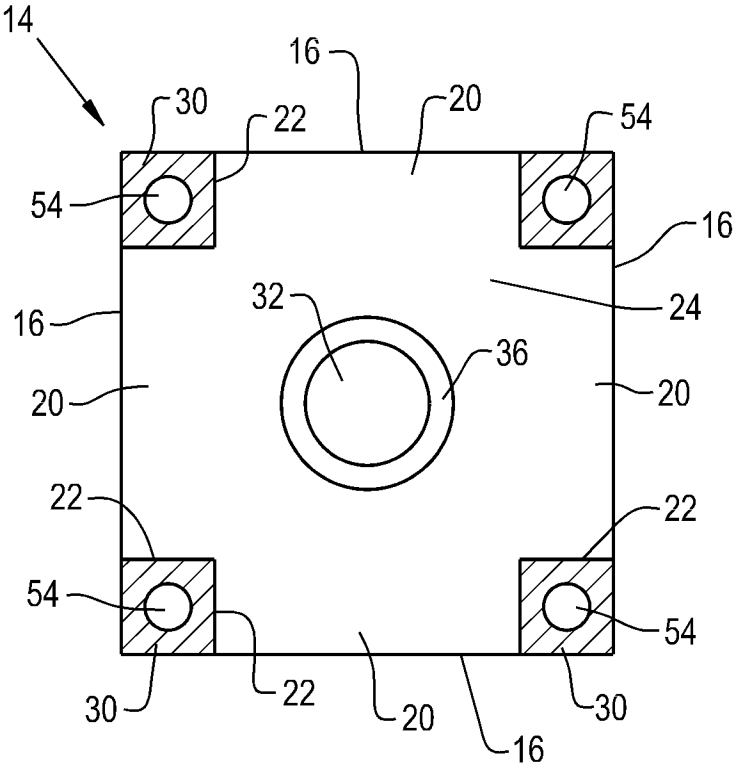
FIGS. 3 and 4 represent cross-sectional views of the rod clamp housing of FIGS. 1 and 2 along section lines 3-3 and 4-4, respectively, of FIG. 2.
Figure 3:
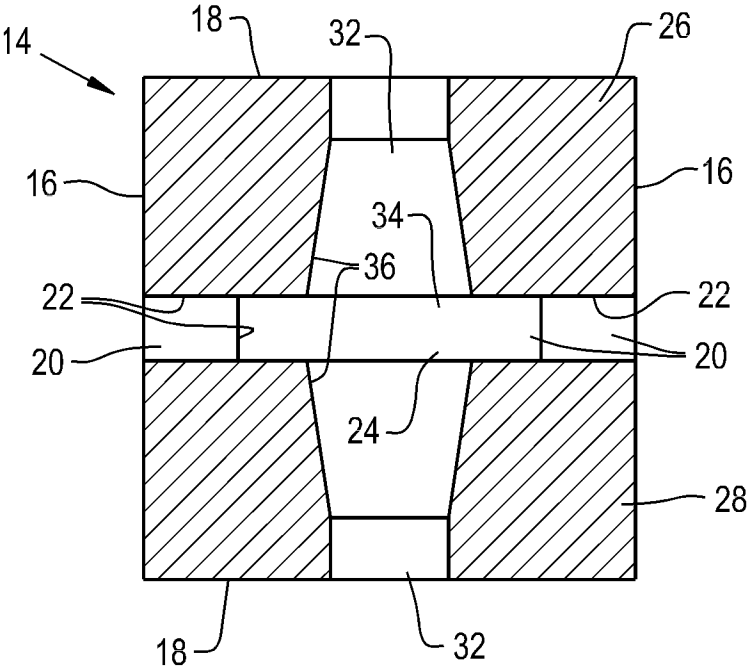
Figure 5:
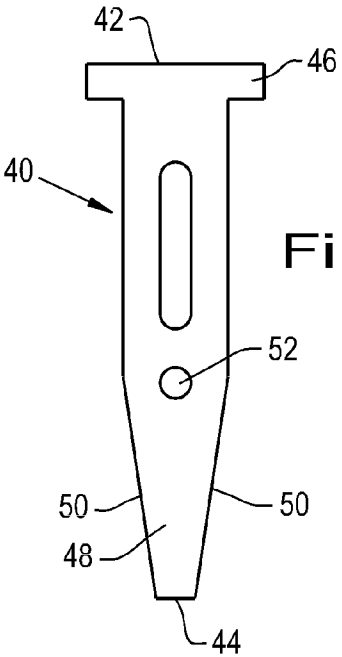
FIG. 5 is a side view of a wedge member adapted for use with the rod clamp housing of FIGS. 1 through 4.
Figure 6:
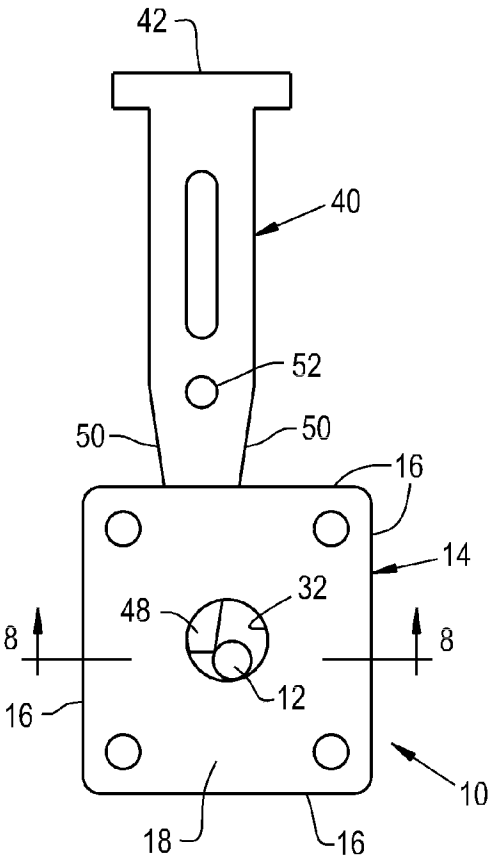
FIGS. 6 and 7 are perspective and end views, respectively, showing the wedge member of FIG. 5 assembled with the rod clamp housing of FIGS. 1 through 4 and securing a rod within the rod clamp housing in accordance with the preferred embodiment of this invention.
Figure 7:
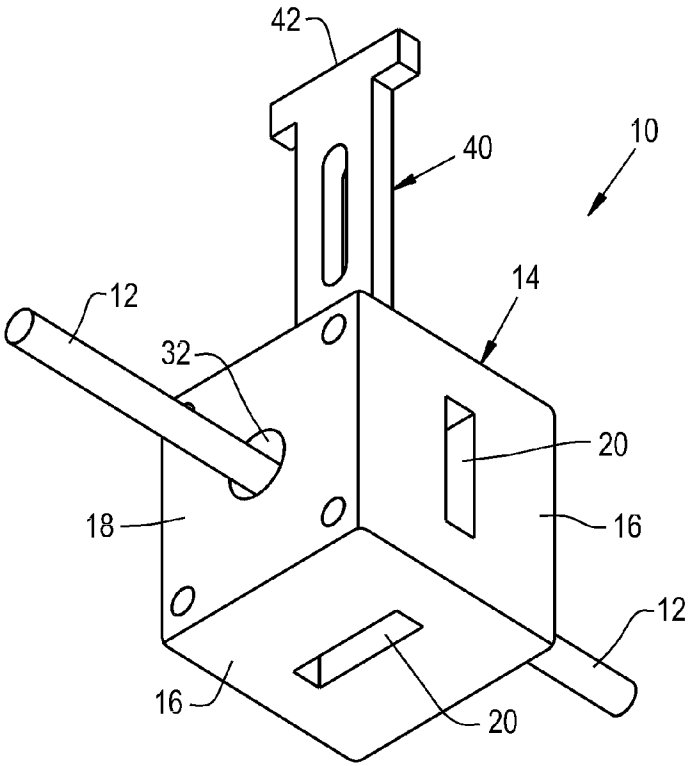

Each pair of sidewalls 16 has a side passage 20 that passes entirely through the housing 14. Preferably, the side passages 20 have identical (or at least congruous) cross-sectional shapes. In the embodiment shown, the side passages 20 have rectangular cross-sectional shapes that correspond to a preferred (but not required) rectangular cross-sectional shape of the wedge member 40, as evident from FIG. 8. Each side passage 20 is defined by side passage walls 22 within the housing 14. The side passages 20 of the pairs of sidewalls 16 intersect each other to define an interior cavity 24 within the housing 14. As seen in FIG. 4, the cavity 24 generally has a cross shape. From FIGS. 3 and 4, it can be appreciated that the housing 14 can be described as comprising two housing members 26 and 28 that are separated by four pillars 30 located at corners of the housing 14. As such, this configuration enables the housing 14 to be an assembly of the housing members 26 and 28, and the pillars 30 can be discrete subcomponents of the housing 14 or defined on either or both of the housing members 26 and 28.

A passage 32 also passes entirely through the housing 14 between the pair of endwalls 18. The passage 32, which may be referred to as an end passage 32, also passes through the cavity 24 within the housing 14 defined by the side passages 20, such that the side and end passages 20 and 32 define an intersection 34 with the cavity 24. The end passage 32 is defined by end passage walls 36 within the housing 14. As evident from FIG. 8, the end passage 32 has a cross-sectional size and shape for accommodating the rod 12. More preferably, the cross-section of the end passage 32 is larger than that of the rod 12. In FIG. 8, the cross-sectional shapes of the end passage 32 and rod 12 are circular, though it is foreseeable that the end passage 32 could have other cross-sectional shapes if a rod having a cross-sectional shape other than round were used. Furthermore, the cross-sectional shape of the end passage 32 has opposing tapers, so that the end passage 32 is larger at the intersection 34 with the housing cavity 24 than at the endwalls 18 of the housing 14.

The wedge member 40 can be specially fabricated for use with the housing 14. Alternatively, commercially available hardware can be used as the wedge member 40, for example, bolts that are commercially available from Dayton Superior under the SYMONS® and STEEL-PLY® line of products. The wedge member 40 represented in FIGS. 5 through 7 has oppositely-disposed longitudinal ends 42 and 44. One end 42 forms an enlarged head 46 adapted to permit the wedge member 40 to be struck with a hammer or other tool to drive the wedge member 40 into one of the side passages 22. At the opposite end 44 of the wedge member 40, a tapered region 48 is defined by a pair of ramp features 50, each defining an edge or camming surface that is not parallel to the longitudinal axis of the wedge member 40. As evident from FIG. 6, the wedge member 40 has a longitudinal length that is sufficient so that the ramp features 50 are able to enter the intersection 34 between the end passage 32 and side passages 20 when the wedge member 40 is inserted through the one of the side passages 20 of the housing 14. The wedge member 40 is further shown as having an abutment feature 52 that can be used to limit the extent to which tapered end 44 of the wedge member 40 can be inserted into the side passages 20 of the housing 14.

As evident from FIG. 8, due to the tapered end 44 of the wedge member 40 and the relative cross-sectional sizes and shapes of the rod 12 and end passage 32, either of the ramp features 50 of the wedge member 40 can be used to force the rod 12 into engagement with the wall 36 of the end passage 32 by inserting the wedge member 40 into one of the side passages 20 of the housing 14. Furthermore, the wedge member 40 can be inserted through either of the side passages 20, whichever is more convenient. Because the end passage wall 36 is tapered, the ramp feature 50 engaging the rod 12 causes the rod 12 to bow, which effectively locks the rod 12 within the cavity 24 of the housing 14. By locking the rod 12 and housing 14 in this manner, the rod clamp assembly 10 and rod 12 can be installed and used to secure and support a concrete form (not shown).

As previously noted, insertion of the wedge member 40 into one of the side passages 20 and into engagement with the rod 12 can be performed with a hammer or other tool. The length of the wedge member 40 between the tapered end 44 and abutment feature 52 can be such that the tapered end 44 protrudes from the housing 14 at the sidewall 16 opposite the sidewall 16 through which the wedge member 40 was installed, which enables the wedge member 40 to be removed from the side passage 20 by striking the tapered end 44 of the wedge member 40. The housing 14 is represented as having holes 54 through which nails, screws, or other suitable fasteners can be driven to temporarily secure the housing 14 to a concrete form during installation and removal of the housing 14.

While the invention has been described in terms of a specific embodiment, it is apparent that other forms could be adopted by one skilled in the art. For example, the physical configurations of the rod clamp housing and wedge member could differ from that shown, and materials and processes other than those noted could be used. Therefore, the scope of the invention is to be limited only by the following claims.

The invention claimed is:

1. A rod clamp assembly comprising:

a housing having sidewalls and endwalls, the sidewalls being arranged to define at least a first pair of sidewalls and the endwalls being arranged to define at least one pair of endwalls, the sidewalls of the first pair of sidewalls being oppositely-disposed from each other, the endwalls of the pair of endwalls being oppositely-disposed from each other, the first pair of sidewalls having a first side passage that passes entirely through the housing and is defined by side passage walls within the housing, the first side passage defining an interior cavity within the housing, the pair of endwalls having an end passage that passes entirely through the housing and through the cavity within the housing to define an intersection with the cavity, the end passage being defined by end passage walls within the housing, the end passage having a cross-sectional shape such that the end passage is larger at the intersection with the cavity within the housing than at the endwalls of the housing;

a wedge member having a first longitudinal end, an oppositely-disposed second longitudinal end, and at least a first ramp feature at the second longitudinal end that defines an edge that is not parallel to a longitudinal axis of the wedge member, the wedge member having a cross-sectional shape congruous to the cross-sectional shape of the first side passage of the housing, the wedge member having a longitudinal length that is sufficient so that the first ramp feature enters the intersection between the end passage and the first side passage when the wedge member is inserted through the first side passage of the housing; and a rod accommodated within the end passage, the rod having a cross-sectional size and shape congruous with the end passage, the cross-sectional shape of the rod being smaller than the cross-sectional shape of the end passage, and the cross-sectional shapes of the rod, the end passage and the wedge member being mutually sized and shaped so that insertion of the wedge member into the first side passage causes the rod to engage one of the end passage walls of the end passage;

wherein the first ramp feature of the wedge member is engaged with the rod to cause the rod to bow within the cavity of the housing, engage one of the end passage walls of the end passage, and lock the rod within the cavity.

2. A rod clamp assembly for securing a rod, the rod clamp assembly comprising:

a housing having sidewalls and endwalls, the sidewalls being arranged to define at least a first pair of sidewalls and the endwalls being arranged to define at least one pair of endwalls, the sidewalls of the first pair of sidewalls being oppositely-disposed from each other, the endwalls of the pair of endwalls being oppositely-disposed from each other, the first pair of sidewalls having a first side passage that passes entirely through the housing and is defined by side passage walls within the housing, the first side passage defining an interior cavity within the housing, the pair of endwalls having an end passage that passes entirely through the housing and through the cavity within the housing to define an intersection with the cavity, the end passage being defined by end passage walls within the housing; and a wedge member having a first longitudinal end, an oppositely-disposed second longitudinal end, and at least a first ramp feature at the second longitudinal end that defines an edge that is not parallel to a longitudinal axis of the wedge member, the wedge member having a cross-sectional shape congruous to the cross-sectional shape of the first side passage of the housing, the wedge member having a longitudinal length that is sufficient so that the first ramp feature enters the intersection between the end passage and the first side passage when the wedge member is inserted through the first side passage of the housing;

wherein the sidewalls of the housing further define at least a second pair of sidewalls, the sidewalls of the second pair of sidewalls being oppositely-disposed from each other, the second pair of sidewalls having a second side passage that passes entirely through the housing and has a congruous cross-sectional shape to the first side passage of the first pair of sidewalls, the first and second side passages intersecting each other to define the cavity within the housing.

3. The rod clamp assembly according to claim 2, wherein the cross-sectional shapes of the first side passage and the wedge member are rectangular.

4. The rod clamp assembly according to claim 3, wherein the cross-sectional shape of the end passage is circular.

5. The rod clamp assembly according to claim 2, wherein the cross-sectional shape of the end passage comprises opposing tapers that cause the end passage to be larger at the intersection with the cavity within the housing than at the endwalls of the housing.

6. The rod clamp assembly according to claim 2, wherein the wedge member has an enlarged head at the first longitudinal end thereof.

7. The rod clamp assembly according to claim 2, wherein the wedge member has an abutment feature between the first and second longitudinal ends thereof that limit the extent to which the wedge member can be inserted into the first side passage of the housing.

8. The rod clamp assembly according to claim 2, wherein the wedge member has a second ramp feature at the second longitudinal end that defines an edge that is opposite the first ramp feature and is not parallel to the longitudinal axis of the wedge member.

9. The rod clamp assembly according to claim 2, further comprising the rod, wherein the rod has a cross-sectional size and shape congruous with the end passage.

10. The rod clamp assembly according to claim 9, wherein the cross-sectional shapes of the rod and the end passage are circular.

11. The rod clamp assembly according to claim 9, wherein the cross-sectional shape of the rod is smaller than the cross-sectional shape of the end passage, and the cross-sectional shapes of the rod, the end passage and the wedge member are mutually sized and shaped so that insertion of the wedge member into the first side passage causes the rod to engage one of the end passage walls of the end passage.

12. The rod clamp assembly according to claim 9, wherein the rod clamp assembly is installed to secure and support a concrete form.

13. A rod clamp assembly adapted to secure a concrete form, the rod clamp assembly comprising:

a rod having a cross-sectional size and shape and configured as a form tie of a concrete form;

a housing adapted to be assembled with the rod, the housing having sidewalls and endwalls disposed transverse to the sidewalls, the sidewalls being arranged to define at least first and second pairs of sidewalls and the endwalls being arranged to define at least one pair of endwalls, the sidewalls of the first pair of sidewalls being oppositely-disposed from each other, the sidewalls of the second pair of sidewalls being oppositely-disposed from each other, the endwalls of the pair of endwalls being oppositely-disposed from each other, each of the first and second pairs of sidewalls having a side passage that passes entirely through the housing, the side passages having congruous cross-sectional shapes and being defined by side passage walls within the housing, the side passages of the first and second pairs of sidewalls intersecting each other to define an interior cavity within the housing, the pair of endwalls having an end passage that passes entirely through the housing and through the cavity within the housing to define an intersection with the cavity, the end passage being defined by end passage walls within the housing, the end passage having a cross-sectional size and shape for accommodating the cross-sectional size and shape of the rod; and a wedge member having a first longitudinal end, an oppositely-disposed second longitudinal end, and at least a first ramp feature at the second longitudinal end that defines an edge that is not parallel to a longitudinal axis of the wedge member, the wedge member having a cross-sectional shape congruous to the cross-sectional shapes of the side passages of the housing, the wedge member having a longitudinal length that is sufficient so that the first ramp feature enters the intersection between the end passage and one of the side passages when the wedge member is inserted through the one of the side passages of the housing.

14. The rod clamp assembly according to claim 13, wherein the cross-sectional shapes of the side passages and the wedge member are rectangular.

15. The rod clamp assembly according to claim 13, wherein the cross-sectional shapes of the end passage and the rod are circular.

16. The rod clamp assembly according to claim 13, wherein the cross-sectional shape of the end passage comprises opposing tapers so that the end passage is larger at the intersection with the cavity within the housing than at the endwalls of the housing.

17. The rod clamp assembly according to claim 13, wherein the wedge member has an enlarged head at the first longitudinal end thereof.

18. The rod clamp assembly according to claim 13, wherein the wedge member has an abutment feature between the first and second longitudinal ends thereof that limit the extent to which the wedge member can be inserted into one of the side passages of the housing.

19. The rod clamp assembly according to claim 13, wherein the cross-sectional shape of the rod is smaller than the cross-sectional shape of the end passage, and the cross-sectional shapes of the rod, the end passage and the wedge member are mutually sized and shaped so that insertion of the wedge member into one of the side passages causes the rod to engage one of the end passage walls of the end passage.

20. The rod clamp assembly according to claim 13, wherein the rod clamp assembly is installed to secure and support a concrete form.

* * * * *